US009396623B2

(12) United States Patent
Lasker

(10) Patent No.: US 9,396,623 B2
(45) Date of Patent: Jul. 19, 2016

(54) EASILY INSTALLABLE HOME ALARM SYSTEM

(71) Applicant: Durwin Keith Lasker, Conway, AR (US)

(72) Inventor: Durwin Keith Lasker, Conway, AR (US)

( * ) Notice: Subject to any disclaimer, the term of this patent is extended or adjusted under 35 U.S.C. 154(b) by 0 days.

(21) Appl. No.: 13/986,106

(22) Filed: Apr. 1, 2013

(65) Prior Publication Data

US 2014/0043158 A1 Feb. 13, 2014

Related U.S. Application Data

(60) Provisional application No. 61/742,477, filed on Aug. 13, 2012.

(51) Int. Cl.

| | |
|---|---|
| ***G08B 23/00*** | (2006.01) |
| ***G08B 1/08*** | (2006.01) |
| ***G08B 19/00*** | (2006.01) |
| *G08B 29/18* | (2006.01) |

(52) U.S. Cl.

CPC ..... *G08B 1/08* (2013.01); *G08B 19/005* (2013.01); *G08B 29/181* (2013.01)

(58) Field of Classification Search

CPC . G06Q 20/1235; G06Q 20/32; G06Q 20/322; G06Q 20/3223; G06Q 20/387; G06Q 20/405; G06Q 30/02; G06Q 30/0222; G06Q 30/0261; G06Q 30/0601; H04L 2209/80; H04L 41/0803; H04L 5/0048; H04L 63/0876

USPC ..... 340/501, 539.13, 686.1, 500, 506–507, 340/517, 524, 533, 528, 529, 532, 539.11, 340/539.14, 545.1

See application file for complete search history.

(56) References Cited

U.S. PATENT DOCUMENTS

| | | | | |
|---|---|---|---|---|
| 2004/0239498 | A1 * | 12/2004 | Miller | 340/539.13 |
| 2007/0008114 | A1 * | 1/2007 | Webb | G06Q 10/08 340/539.13 |
| 2008/0191857 | A1 * | 8/2008 | Mojaver | 340/500 |
| 2010/0023865 | A1 * | 1/2010 | Fulker et al. | 715/734 |
| 2011/0260880 | A1 * | 10/2011 | Dean et al. | 340/686.1 |
| 2012/0324566 | A1 * | 12/2012 | Baum et al. | 726/12 |

* cited by examiner

*Primary Examiner* — Daniel Previl

(57) ABSTRACT

A unique alarm system and mobile security system that utilizes the existing wiring in the area the user is trying to secure, and so it is very easy to install. The alarm system is when the security of the user's dwelling is breached, when the monitors are separated from each other, similar to a traditional alarm system. The monitors comprise one receiver and one magnet. The receiver and magnet are placed next to each other; one usually goes is placed on the window or window frame, door or door frame. The receiver sends a remote signal to the alarm system Debo Alarm System (D.A.S.) when the magnet is removed, saying that the window or door is open. The receiver or magnet can be stationary or movable.

17 Claims, 13 Drawing Sheets

EASILY INSTALLABLE HOME ALARM SYSTEM

REFERENCES TO RELATED APPLICATIONS

This application claims priority to U.S. Provisional Application 61/742,477, filed on Aug. 13, 2012, with Durwin Lasker as the inventor, which is hereby incorporated by reference in its entirety.

FIELD OF THE INVENTION

The invention relates generally to the field of home and business alarm systems, and more specifically to the field of alarm systems that can be deployed easily in a building without substantial redesign of the building's circuitry.

DESCRIPTION OF THE RELATED ART

Needs Filled by the Invention

Home alarm systems have been known for decades. In general, a home alarm system electronically monitors various entryways in a user's residence. If someone attempts to gain access to one of the entryways during the time that the alarm system is "activated", then the alarm system will generally make a loud noise, to alert everyone nearby to the security breach.

Most home alarm systems comprise a base station, which contains a keypad, and small monitoring sensors near different windows and doors. The base station must be installed into the wall of the user's residence, and this requires an expensive installation, and rewiring of the circuitry within the walls. A prospective user must generally wait several days, in order for a specialized technician to install the base station into the user's residence. This means that the user will be without the protection of a security system during those days. Installation of the system will also generally come with a cost, or the security company may choose to waive the cost if the buyer agrees to a multi-year service contract with monthly payments. These costs may be significant to many users.

Many home alarm systems are designed in a manner which will prevent them from functioning if they are not part of the centralized system of a specific security company. This also means that a user must sign up for monthly service by the security system in order to make use of a home alarm system after it has already been installed.

Furthermore, the costs of monthly service can make security systems prohibitively expensive to many potential users. For example, a person renting a studio apartment for $500 per month may be unable to pay the $30 per month cost of a home security system. Thus, people living in poorer areas may not have access to home security systems, which is doubly unfortunate, because poorer areas tend to have higher crime, and so those living in less economically well-off areas are the people who may most need security systems. Individuals such as college students and those who rent or own smaller dwellings would also benefit from security systems that are cheaper to install and do not have monthly service costs. In addition, those who rent their residences, in general, cannot rewire the electrical systems of those dwellings to accommodate conventional security systems. A renter will usually need the landlord's permission to rewire the electrical system of the rented dwelling, and landlords are usually reluctant to give this permission. Furthermore, most residential rental units in the United States are rented for one-year leases, and most home alarm companies require three-year service contracts for their alarm systems. This is an obstacle for renters, who would like to have home alarm systems. Therefore, individuals who rent their residences have particular need of a type of home security system that does not require the electrical systems of the home to be rewired, and which does not require a three-year service contract with an alarm company.

The base station of a home security system requires connection to some kind of electrical power system, in order to remain functional all of the time, and not run out of power. This is one of the reasons why the base station needs to be connected to the electrical system of the residence or other building for which it is providing security. The base station needs to remain functional all of the time, because that way it can perform its functions. The keypad and module system of the present invention need electrical power to perform their tasks such as making a loud noise, or automatically calling the police, whenever an intruder attempts to gain unauthorized access to the building for which the security system is providing security.

SPECIFIC PRIOR ART INVENTIONS

We will now examine specific inventions of the prior art. Patent application 2007/008114 by Webb discloses a group of sensors connected to a global operations monitoring sensor. This is different from the present invention, because Webb's invention obviously requires substantial fixed investment at the global operations monitoring center, and does not seem to include the ability for the sensors to be connected to a base station, keypad, or mobile monitor within the same building, which can easily be installed within that building. There is no evidence that Webb's invention includes a similar capability. Furthermore, the intent of Webb's invention is clearly for security monitoring of products within a worldwide distribution network, which is different from the intent of the present invention.

Patent application 2011/0260880 by Dean discusses a solar-powered alarm system, but the intent of Dean's invention, and the needs that it is supposed to fulfill, are different from those of the present invention. Furthermore, Dean's invention does not appear to include the present invention's capacity to be installed easily into the existing wiring of a home or office.

Patent application 2008/0191857 by Mojaver discloses a type of alarm system that is always armed and communicates with police and various others via VoIP. Mojaver's application lists the problems that it was designed to solve in paragraphs 26-59 in Mojaver's application. The problems solved by Mojaver's invention are different from the problems solved by the present invention. Furthermore, Mojaver does not include the easily installable Base Station of the present invention. The intent of Mojaver's device appears to be focused on getting warnings quickly to as many people as possible when a home's security is breached, and Mojaver's invention is adapted to this purpose.

Patent application 2010/0023865 by Fulker discloses an integrated security system, which includes software that coordinates various security features. FIG. 1 of Fulker makes clear that the integrated security system is coupled to a conventional home security system. Therefore Faulkner's invention is fundamentally different from the security system of the present invention, which is cheaper and easier to install than Faulkner's invention.

Patent application 20120324566 by Baum discusses a method of connecting two security systems and exchanging information. Some of the embodiments of the method include touchscreens and various forms of software. This is substantially different from the present invention because the two security systems in Baum's invention are conventional, while the present invention focuses on one security system that is different from conventional systems.

Patent application 20040239498 by Miller discloses a group of methods that track a cellular phone user who reports an emergency and enable emergency personnel to more quickly respond to that emergency. However, the electronic systems which Miller describes are conventional and designed for a different purpose from those of the present invention. The present invention is a home security system, not a method for tracking locations of cellular phones.

A new type of alarm system is necessary that can be installed easily into a building or residence, without having to rewire the electrical system of the building or residence. This new type of alarm system should ideally also be capable of operating without a monthly service charge paid to an alarm company. The base station of the security system should also be capable of functioning without running out of power, therefore, it should be capable of being attached to a building's power system. The security system should also be capable of complex tasks such as the ability to have a "security code" programmed into it. The security system should also be capable of being installed quickly. Furthermore, the security system should also be capable of fulfilling other functions, such as detecting carbon monoxide. The present invention fulfills all of these goals.

SUMMARY OF THE INVENTION

Different embodiments of the invention involve the following parts, referred to by the following numbers: (1) Mobile module. (2) Keypad. (3) Base station (4) Carbon monoxide detector. (5) Speakers. (6) monitor. (11) Internal rechargeable battery. (12) Snaps. (13) Data transfer port. (14) AC/DC adapter (which recharges the internal battery). (19) monitor set button. (20) Motion detectors. (22) Sensitivity Switch. (24) Positive connection. (26) Negative connection. (27) Keypad slot. (28) Screw hole. (29) Power, data, and information connection. (33) Perimeter Sensor. (37) Perimeter battery. (30) Magnet. (31) Receiver. (32) Perimeter button. (34) Solar panel. (40) Laser. (36) Laser reader. (38) Light and motion detector. (39) Stake. (41) Perimeter sensor adapter. (42) Digital touch screen display. (44) Motion detector adapter. (46) 911 function button. (50) Keypad input adapter. (54) Mobile module battery. (56) Mobile module charger inlet. (60) Keypad battery. (61) Keypad power inlet. (62) Keypad information port. (65) Mobile module AC/DC inlet.

It is important to note that though the terms "dwelling" or "residence" will sometimes be used in this application to denote the area being secured by the Debo Alarm System Phase II, the Debo Alarm System Phase II can also be used to secure areas such as automobiles, trucks, boats, airplanes, "RVs" (recreational vehicles), camping sites, hotel rooms, dormitories, conference rooms, and business buildings. Therefore, unless otherwise noted, the explanations of how the Debo Alarm System Phase II functions, that reference the user's "dwelling" or "residence" will apply equally to these other areas.

Here, a "light switch" will be taken to mean the light switches of the type that are on the walls of most U.S. homes, which turn on electric lights.

The primary embodiment of the invention will be described below. It is important to note that other variations of the invention are possible, which will remain within the spirit of the claimed invention. For example, the batteries and ports for inputting data located within the base station, mobile module, and keypad can be located in other areas of these components from the areas where they are indicated here. The batteries of the base station, keypad, and mobile module also could be unconnected to the parts of the base station, keypad, and mobile module that are designed to input electrical power. This would also be within the spirit of the claimed invention, but would probably be less effective than the embodiments discussed below. Some of the most vital characteristics of the invention are that the invention includes an easy-to install base station that can be installed in a dwelling in the same manner that a light switch panel is installed in the wall of a dwelling, where the base station connects to a detachable keypad which the user can use to set his security code and other information.

THE STRUCTURE OF THE PRIMARY EMBODIMENT AND OTHER EMBODIMENTS

The invention is called the "Debo Alarm System Second Phase", or D.A.S.S.P. The primary embodiment of the Debo Alarm System Second Phase comprises a base station (3), and a mobile module (1) and a keypad (2). There are also sensors that transmit to the base station, and/or keypad, and/or mobile module, and inform these components when the security of the user's dwelling has been breached. The invention may include receivers (31) and magnets (30), and various perimeter sensors (33), light and motion detectors (20), other types of sensors, or all of these types of components.

The Base Station

The base station (3) is the part of the Debo alarm system that, when the mobile module (1) and keypad (2) are attached to the base station (3), contains most of the Debo alarm system's features and also usually uses the most electrical power. The base station (3) can be attached to the wall of a user's residence in the same way that the panel containing a light switch is attached, explained below. The size of the base station (3) helps with this, because the base station (3) should usually be 5 and 9/16 inches (14.129 cm) in length, and 4 and 9/16 inches (11.59 cm) in width, and the back part of the base station is smaller, which helps the back part of the base station to fit into the space in the wall normally occupied by a light switch panel with two individual switches. Most of the benefits of the invention, however, will still be achieved if the base station has a different size. Some embodiments of the base station (3) also have keypad slots (27) which allow the keypad (2) to be "slid" onto the base station, and to remain linked to, and supported by, the base station (3), when desired by the user. These versions of the invention will work best with a keypad that has notches to slide into the keypad slots (27). Other versions of the invention have snaps (12) which allow the keypad to be "snapped" onto the base station. Still others could theoretically have both a keypad slot (27) and snaps (12). The base station (3) also attaches to a keypad (2), in which the user can enter information, and which can attach to a mobile module (1) which can communicate with the base station (3) and/or keypad (2) via wireless communication if the user takes the mobile module (1) out of the user's residence. Both the keypad (2) and the mobile module (1) can be detached from the base station (3).

The base station also includes an internal, rechargeable battery (11) which keeps the base station functional and powered for a time when it is not connected to a power source. There is also an AC/DC charging outlet (14) that is connected to the rechargeable battery (11), and a user can plug a charger into the AC/DC charging outlet to recharge the rechargeable battery (11) and power the base station (3). Chargers that will fulfill this function are well-known in the prior art.

Furthermore, the base station includes a data transfer port (13), which allows a user to use a USB cord or other cord capable of carrying data to attach said cord to the base station (3) and the keypad (2) and transfer data and information between them. This data transfer port will also function with other data transfer paraphernalia that function using the same principles as a USB cord.

The base station can include a monitor set button (19) which activates the monitors after they have been set in the desired places. In others variants of the invention, a monitor set button (19) can be part of the keypad (2) or the mobile module (1), or more than one of the mobile module (1), keypad (2), or base station (3). Monitor set buttons (19) are part of the keypad (2) and mobile monitor (1) in the preferred embodiment. If one of the magnets (30) is separated from a receiver (31) after that, the receiver (31) will inform the keypad (2) of this, and the speakers (5) will make a loud noise. In another version of the invention, the receiver (31) will inform the mobile module (1) directly of the security breach, and the speakers (5) will make a loud noise. The base station (3) should also be able to receive data from a digital display (42) which is part of the keypad (2), and which the user can use to input data. The keypad can then communicate this data to the base station.

The digital display (42) is capable of receiving via the keypad, a secret code to arm the security system, and the digital display is capable of receiving, three phone numbers to contact in case on an emergency, and also the user's identity and contact information. The digital display (42) can also receive the number of people living within the dwelling being secured against intrusion, and the exact location of the residence that the system is guarding (such as the exact apartment number, if the system is placed in an apartment). These items will be inputted by the user into the keypad (2) and stored in a memory in the keypad (2) or base station (3). The keypad can then transmit this information directly to a "911" operator or other emergency services operator, if the security of the user's dwelling is breached.

The keypad, which contains the digital display, is detachable from the base station. Depending on which version of the keypad and base station are used, the keypad may be attached to the base station by a keypad slot (27), snaps, or interlocking snap-fits (Interlocking attachment features), that "snap" the keypad into the base station, but can be undone, if desired by the user, so that the keypad may be removed if desired.

Alternatively, the keypad may contain slots, which allow it to be slid into the base station (3) on runners or notches or snap-fits. The snaps or slots would be on the rectangular walls of the keypad, so that the keypad could be slid into the base station (3) on the slots, or could be moved into place, and then the snap-fits activated so that the keypad is attached to the base station (3).

A keypad could also theoretically be designed with both slots and snaps, for extra protection and strength in holding the keypad in place.

The mobile module, is also detachable from the keypad. Depending on which version of the mobile module and keypad are used, the mobile module may be attached to the keypad by snaps, or snap-fits, that "snap" the mobile module into the keypad, but can be undone, if desired by the user, so that the mobile module may be removed if desired.

Alternatively, the mobile module may contain slots, which allow it to be slid into the keypad (2) on runners or notches. The runners will fit into the slots on the keypad, when pressed by the user, allowing the mobile module (1) to be attached to the keypad (2). Alternatively, the mobile module can contain the runners, slots, or snaps, and the keypad (2) can contain the slots which are supposed to fit together with the runners, allowing the mobile module to be attached to the base station.

A mobile module could also theoretically be designed with both slots and snap-fits, for extra protection and strength in holding the mobile module in place.

The keypad (2), when installed in the user's residence, will be in communication with the perimeter sensors (33), monitors (6), light and motion detectors (20), and any other sensors that are part of the Debo alarm system. These sensors are designed to inform the keypad (2) and the mobile module (1) when the security of the user's residence has been breached, because these sensors are designed to detect the motion created by such a security breach. The sensors report this motion to the keypad (2) and mobile module (1), which will interpret the motion as a security breach.

The base station has the capacity to communicate with the mobile module and/or keypad via the physical ports discussed herein, when attached to the mobile module and/or keypad. The base station can also communicate wirelessly with the mobile module and/or keypad when detached from these components.

The Display and Keypad

The digital display (42) is part of the keypad (2). The digital display (42) is the screen of the keypad and can display information entered into the letter and number buttons on the keypad (2). The keypad (2) is a component that has at least two modes, "letter mode" and "number/symbol mode". In the letter mode, the user can enter letters, and in number/symbol mode, the user can enter numbers and symbols. Technology and software that allow a keypad to switch between letter mode and number/symbol mode, and to accommodate both, is well-known in the prior art. The keypad can have digital keys, which are known in the prior art. If the keypad (2) has digital keys, they will be images of the keys displayed on the digital display (42), which will be a touchscreen, so that the user can press the digital keys by pressing on the images on the screen.

The keypad (2) is configured so that the user can enter the number of people living in the dwelling, three phone numbers to be contacted in case of an emergency, a safety code, and the user's specific location within a building (For example, if the user is in Apartment 3A, then the user can enter "Apartment 3A" in the keypad (2)). The user can also enter whether he or she lives on the bottom, top, right side, left side, or next to a structure.

This information is then stored in a memory, and, if the system calls "911", this information can be given to the 911 operator. This will make it much easier for the 911 operator to send help to the user. This additional information would presumably allow the help to arrive faster. The keypad (2) can also have a keypad input adapter (50) that has the capacity to receive data from the base station (3) that is carried over a USB cable or another similar data transfer method. This keypad input adapter will then transfer the information that it receives to the rest of the keypad.

Most variations of the keypad (2) will also include a monitor set button (19) that a user can use to enter the safety code to arm the alarm system when leaving his dwelling, and other information. When the security system is "armed", it will make a loud noise when any of the sensors that are part of the system detects an intrusion into the secured area. The mobile module (1) is attached to the keypad (2) by snaps, slots, or by another method. The keypad (2) includes a carbon monoxide detector (4) and a 911 function button (42). This allows the keypad (2) to call 911 and detect carbon monoxide even when the mobile module (1) is separated from it. Therefore, a user can have the components of the keypad (1) detect carbon monoxide and automatically call 911 in his dwelling, if necessary, while taking the mobile module somewhere else, and having the components of the mobile module detect carbon monoxide and call 911, if necessary, in that location.

The keypad includes the ability to communicate with the mobile module (1), which contains speakers, so that when the keypad (2) receives transmissions from the perimeter sensors (33) and receivers (31), and motion sensors (20) so that when one of the perimeter sensors (33) or receivers (31) or other sensors that is part of the system transmits to the keypad (2) that the user's security has been breached, the keypad (2) can tell the mobile module to sound the speakers (5) and call "911" or other emergency services, if programmed to call them. If the keypad also includes speakers, those speakers will sound too.

The keypad also includes a power, data, and information connection (29) that allows electricity and information to be transmitted to the mobile module. This information can include items such as the codes set by the user. In addition the keypad (2) has a keypad battery (60) so that when electrical power is received from the base station, it can be stored in the keypad battery (60) so that the keypad can function for more time.

The keypad has the capacity to communicate with the mobile module and/or base station via the physical ports discussed herein, when attached to the mobile module and/or base station. The keypad can also communicate wirelessly with the mobile module and/or base station when detached from these components.

The keypad can also include speakers (5), which can make a loud noise whenever the security of the user's dwelling is breached, or a dangerous amount of carbon monoxide is detected.

The Mobile Module

The mobile module (1) is part of most embodiments of the Debo alarm system. It is attached to the base station (3), or the keypad (2). The mobile module includes a carbon monoxide detector (4) and a "911" function button. The carbon monoxide detector (4) detects whether there is a dangerous concentration of carbon monoxide in its vicinity, and alerts the user. It can alert the user by sounding the speakers. The 911 function button can be pre-programmed to automatically make a telephone call to "911", the U.S. emergency services number, when an intruder breaks into the user's residence, or when the keypad, and the other components of the Debo alarm system that are in communication with the keypad, inform the mobile module (1) that the security of the user's residence has been breached. The sensors in some embodiments of the invention can also communicate directly with the mobile module, and inform it that the security of the secured area has been breached. If the user's residence is in another country, and the user purchased the Debo alarm system in that country, the 911 function button will be programmed to call the emergency services number for that country (such as "999", the British emergency services number, for residences in the United Kingdom). It will also alert the user when an intruder breaks into the user's residence.

The 911 function button will only automatically call "911" when the user's dwelling's security has been breached if the user has previously programmed it to call "911", and this pre-programming must be done while the mobile module (1) is attached to the base station (3) or keypad (2) (depending on which version of the invention is being used). The 911 function button is designed so that, when the mobile module (1) is attached to the base station (3), or keypad (2), the user can easily indicate whether he or she wishes the 911 function button to call 911 in the event of a security breach.

The mobile module is highly useful, partly because it can be detached from the base station (3) or keypad (2) and carried with the user when the user is on vacation or otherwise away from home. The mobile module can therefore protect the user while the user is away from his or her dwelling, and also protect the dwelling itself. The mobile module will then inform the user if there has been a break-in at the user's residence, or if there is a dangerous quantity of carbon monoxide in the vicinity of the mobile module. There are several technologies, such as wireless communication of the type used by cellular phones, that will allow the mobile module (1) to remain in communication with the keypad (2) when the mobile module is outside of the user's residence. The snap-fits and slots above allow the user to detach the mobile module (1) from the base station (3) or keypad (2) if desired.

The mobile module (1) also includes an operative connection between the carbon monoxide detector (4), which can detect a dangerous presence of carbon monoxide, and the speakers (5) so that when carbon monoxide has been detected, the mobile module will sound the speakers (5). The speakers project intense sound when they are sounded.

The speakers (5) can also sound when the security of the user's dwelling is breached. The various types of sensors discussed herein will inform the keypad (2) of the security breach, and the keypad (2) will inform the mobile module (1) of the breach via wireless communication, and the mobile module (1) will sound the speakers (5). Alternatively, the sensors can inform the mobile module (1) directly of the security breach by communicating with the mobile module if it is within communication range of the sensors. The various types of sensors discussed herein can also directly inform the mobile module (1) of the security breach.

The user can use both the mobile module (1) and keypad (2) to set the security code, which arms the security system when set. It is set by the number of times that the user pushes the Carbon Monoxide button. The user should push the monitor set button (19) on either the mobile module or keypad, first, then set the security code. Once the security code is inputted, the system will be armed in ten seconds. Other embodiments of the invention can be designed that arm the security system in five seconds, twenty seconds, or other time periods.

The mobile module (1) also includes an internal, rechargeable mobile module battery (54) and a charger inlet (56) so that it can be plugged into a wall socket, and charged, like a cellular phone. The charger inlet connects to the mobile module battery, and delivers electrical charge to the mobile module battery. The mobile module can also connect to the keypad and receive and send data via the charger inlet.

The mobile module has the capacity to communicate with the keypad and/or base station via the physical ports discussed herein, when attached to the keypad. The mobile module can also communicate wirelessly with the keypad and/or base station when detached from the keypad.

The user can, in principle, take the mobile module, and some sensors, away from his or her dwelling to another location, set the sensors up in that location, and the mobile module will communicate with those sensors using a technology similar to Bluetooth. The mobile module includes the capability to communicate with these sensors in a manner similar to Bluetooth. Then, if the security of the other area is breached, the sensors will inform the mobile module of this, and the speakers on the mobile module will sound.

The Motion Detectors

The motion detector (20) is a separate component from the mobile module (1) and the base station (3). The user places the motion detector (20) in an area which they wish to monitor, so that anything that moves into that area will be detected. The system, when armed, will assume that anything that moves into the monitored area and is detected will represent an intrusion and a security breach. The invention allows more than one motion detector (20) to be used in a single dwelling with one base station (3). The sensitivity of each motion detector can be controlled, and each motion detector will have a sensitivity switch (22), which can be set at "high", "medium", and "low" sensitivity. If it is set at "high" sensitivity, then it will detect smaller movements in the target area. The motion detector (20) transmits to the keypad and/or mobile monitor, so that when the motion detector (20) detects movement in an area which is supposed to be secured, it transmits this information to the keypad, which, if programmed to do so, will sound any speakers that it is equipped with, and will tell the mobile module (1) to sound speakers (5) and call 911.

The motion detector (20) should ideally be placed in areas that an intruder will have to cross, to gain access to the rest of the user's dwelling. The motion detectors (20) can be set to monitor specific areas of the user's dwelling when the user is not home. The motion detector can also be used to signal the user when someone is driving down the user's driveway, or walking in areas outside the user's dwelling such as the user's front yard.

The front of the motion detector (20) will generally be the part that detects motion.

The motion detector (20) also includes a motion detector adapter (44) which can be plugged into an electrical source to help power it. The motion detector adapter (44) is placed on the back of the motion detector (20) so that the motion detector (20) can be easily placed in the corner of a room.

The Monitors

Each monitor (6) includes at least a magnet (30) and a receiver (31). The user places the magnet (30) and the receiver (31), in a manner so that the magnet (30) and the receiver (31) touch each other, on the door or window or other entryway, or safe, that needs to be secured. They should be placed on the door and the doorway, if used to secure a door, or the window and the windowsill, if used to secure a window, or otherwise on two locations that will separate if the entryway or safe is opened. When the entryway is closed, the receiver (31) senses the presence of the magnet (30) touching it. If the entryway opens, the receiver (31) will no longer sense the presence of the magnet (30) touching it. If the system is armed, the system will consider the opening of the entryway, and separation of the magnet and receiver, to be an intrusion and a security breach. The receiver (31) is capable of communicating wirelessly with the keypad (2), and informs the keypad (2) when the magnet (30) is separated from the receiver (31). The keypad (2) will then tell the mobile module (1) to sound the alarm and perform any other tasks that it has been programmed to perform. Some versions of the invention allow the monitors (4) to communicate directly with the mobile module.

The receiver (31) has the ability to sense whether the magnet (30) is touching it, and signals the keypad (2) if the magnet is not touching it. The receiver (31) and the magnet (30) should be designed to physically fit together, as shown by the example in FIG. 12, where the receiver (31) and magnet (30) are both rectangular and can fit against each other. This is how the monitors (6) function.

The Perimeter Sensors

Each perimeter sensor (33) contains a perimeter button (32) that "turns on" the perimeter sensor (33) and causes it to start monitoring the location that it is supposed to monitor, when the user presses the perimeter button (32). The perimeter button (32) is operatively connected to the laser (40) and turns it on when the perimeter button (32) is pressed. The laser (40) then shoots a laser beam outwards. It should be aimed at another nearby perimeter sensor (33), so that the laser beam hits the laser reader (36) of the other perimeter sensor (33). In this way, each of the laser beams between two perimeter sensors (33) will serve as a barrier. When an intruder tries to go through the barrier, the laser beam will be broken. When the laser beam is broken, the laser reader (36) which it is aimed at will no longer receive the laser beam. The system will consider this to be an intrusion and a security breach if the system is armed. The perimeter sensor (33) which this laser reader (36) is attached to will then alert the keypad (2), which will then sound an alarm, in the manner elsewhere described in this application, Laser beams which are of sufficiently low intensity that they will be invisible and will serve the purposes discussed here are known in the prior art.

The laser (40) and laser reader (36) of each perimeter sensor (33) may be on opposite sides of the perimeter sensor (33), on the same side, or at another angle relative to each other. Each perimeter sensor could theoretically have multiple lasers and multiple laser readers.

A user can place the perimeter sensors (33) in locations so that the laser beams which they create form a complete perimeter, with each laser beam hitting the laser reader of another perimeter sensor (33). An example of this, not the only possible example, is four perimeter sensors, each of which has a laser reader (36) at a 90-degree angle to its laser (40). The laser beams that the lasers (40) create in this example will form a square perimeter, with each laser beam hitting the laser reader (36) of another perimeter sensor (40).

The perimeter sensor also has a light and motion detector (38) inside it. This light and motion detector will detect intruders coming into the secured area, which the system, if armed, will consider to be an intrusion and a security breach. The perimeter sensor (33) will then transmit this information to the keypad (2) which will make an alarm.

Each perimeter sensor should have an internal, rechargeable perimeter battery (37), and a solar cell (34). The perimeter battery (37) will power the perimeter sensor (33) so that components such as the laser and laser reader can function. The laser, laser reader, and light and motion detector (38) are all connected to the perimeter battery (37) in a way that allows them to be powered by the perimeter battery (37). The laser, laser reader, and light and motion detector (38) are all connected to the solar cell (34) in a way that allows them to be powered by the solar cell (34). The solar cell (34) is connected to the perimeter battery (37), and gradually recharges the perimeter battery (37) during the day. The perimeter battery (37) should then have enough power for the perimeter sensor (33) to function for an entire night. The solar cell should also be placed on the perimeter sensor (33) in a position where large amounts of sunlight will hit the solar cell (34) during the day. In the example in FIG. 13 the solar cell (34) is on the top of the perimeter sensor (33).

The perimeter sensor (33) will also have at least one perimeter sensor adapter (41) which is a charging outlet in which a user can plug in his or her cellular phone charger or the mobile module (1). The perimeter sensor adapter (41) has the potential to recharge either of these two instruments, or a laptop computer, and the perimeter sensor adapter (41) will be connected to the perimeter battery (37).

Each of the perimeter sensors (33) may have a stake (39) attached. A user can place the perimeter sensor (33) into the ground, so that the perimeter sensor (33) will be securely positioned in the ground, by driving the stake (39) into the ground.

In one method of operation of the invention, after the user has previously entered the telephone numbers to call in the event of an emergency, and his exact apartment number, into the keypad (2), and programmed the 911 function button to call "911" when the dwelling's security is breached, the user takes the mobile module (1) out of his or her dwelling. The perimeter sensors (33), monitors (6), and motion detectors (20) inform the keypad (2), via wireless communication when the security of the user's dwelling is breached. The keypad (2) will then and use wireless communication to contact the mobile module (1). The mobile module (1) will then sound its speakers (5) and call 911, and inform the 911 operator of the exact apartment number of the user's apartment. The police will then go to the apartment and arrest the burglar.

How to Install the Debo Alarm System

A user can easily install the Debo alarm system second phase in the same manner that a light switch is installed. First, the user turns the power off in the area where the light switch is located. Then, the user uses a screwdriver to unscrew the ground screws that hold the light switch to the wall. Third, the user places the positively charged wire from inside the wall around the positive connection (24) and the negatively charged wire from inside the wall around the negative connection (26). The user then tightens both the positive connection and negative connection with a screwdriver. The positively and negatively charged wires will be standard features of the wiring inside the wall, which feeds any light switch. The user then places the back of the base station (3) into the hole in the wall left by the light switch, and screws the ground screws into the screw holes (28). This will attach the base station (3) into the wall and install it. The mobile module (1) and keypad (2) will then be attached to the base station (3).

The keypad will then light up, indicating the D.A.S.S.P. is ready to be set up for service. The user should then hold the monitor set button on the keypad until the keypad (2) blinks twice. When it blinks twice, the keypad (2) is indicating that it is ready for the user to enter his or her information. The user can then set up an alarm security code that can be up to 8 characters. For example: (1234safe), and/or a security code can be the user's mother's maiden name, favorite movie etc. . . . .

After the user has entered his information, the user should push "enter" then push and hold the monitor set button (19). When the keypad beeps it is indicating that the user's information has been saved.

The D.A.S.S.P. will ask the user if the user is ready to set up the motion detectors and the perimeter sensors (If perimeter sensors are applicable). After placing the detectors in their desired locations the user should push and hold the monitor set button (19). The D.A.S.S.P. will inform the user that the motion detectors are set. After placing the perimeter sensors in their desired locations around the user's property the user should push and hold the re-set button. The D.A.S.S.P. will tell the user that the perimeter sensors are set.

After setting up the D.A.S.S.P., the user should test to see if the alarm system is working. After checking doors, windows, motion detectors, perimeter sensors and lights on/off, to make sure that these are working, the user may check the 911 function by having the system call 911. The 911 function should display all of the user's information onto the 911 operator's terminal. If the user chooses to do this, the user should make sure to indicate to the 911 operators that he is checking his new D.A.S.S.P., and give the operators the security code. The user should also ask the 911 operator who answers the phone whether the user's information displayed onto the 911 operator's terminal. If not, the user should test the alarm system again.

A Second Version of the Debo Alarm System

In a second version of the Debo alarm system, the perimeter sensors, light and motion detectors, and monitors are in wireless communication with the mobile module (1). A user may also have some perimeter sensors, light and motion detectors, and monitors in communication with the keypad (2) at a primary location, and have other perimeter sensors, light and motion detectors, and monitors at a second location, where they will be in wireless communication with the mobile monitor (1) when it is within range.

It is important to note that the mobile module and keypad are in wireless communication with each other, so that, in the specification and claims, when mention is made of the keypad (2) causing the speakers (5) to make a loud noise, it is understood that this can mean that the keypad (2) is either causing speakers located in the keypad to make a loud noise, communicating with the mobile module in a manner which causes the mobile module to cause speakers located in the mobile module to make a loud noise, or both. Likewise, when mention is made of the mobile module (1) causing the speakers (5) to make a loud noise, it is understood that this can mean that the mobile module (1) is either causing speakers located in the mobile module to make a loud noise, communicating with the keypad in a manner which causes the keypad to cause speakers located in the keypad to make a loud noise, or both.

DETAILED DESCRIPTION OF THE DRAWINGS

Figure 1:
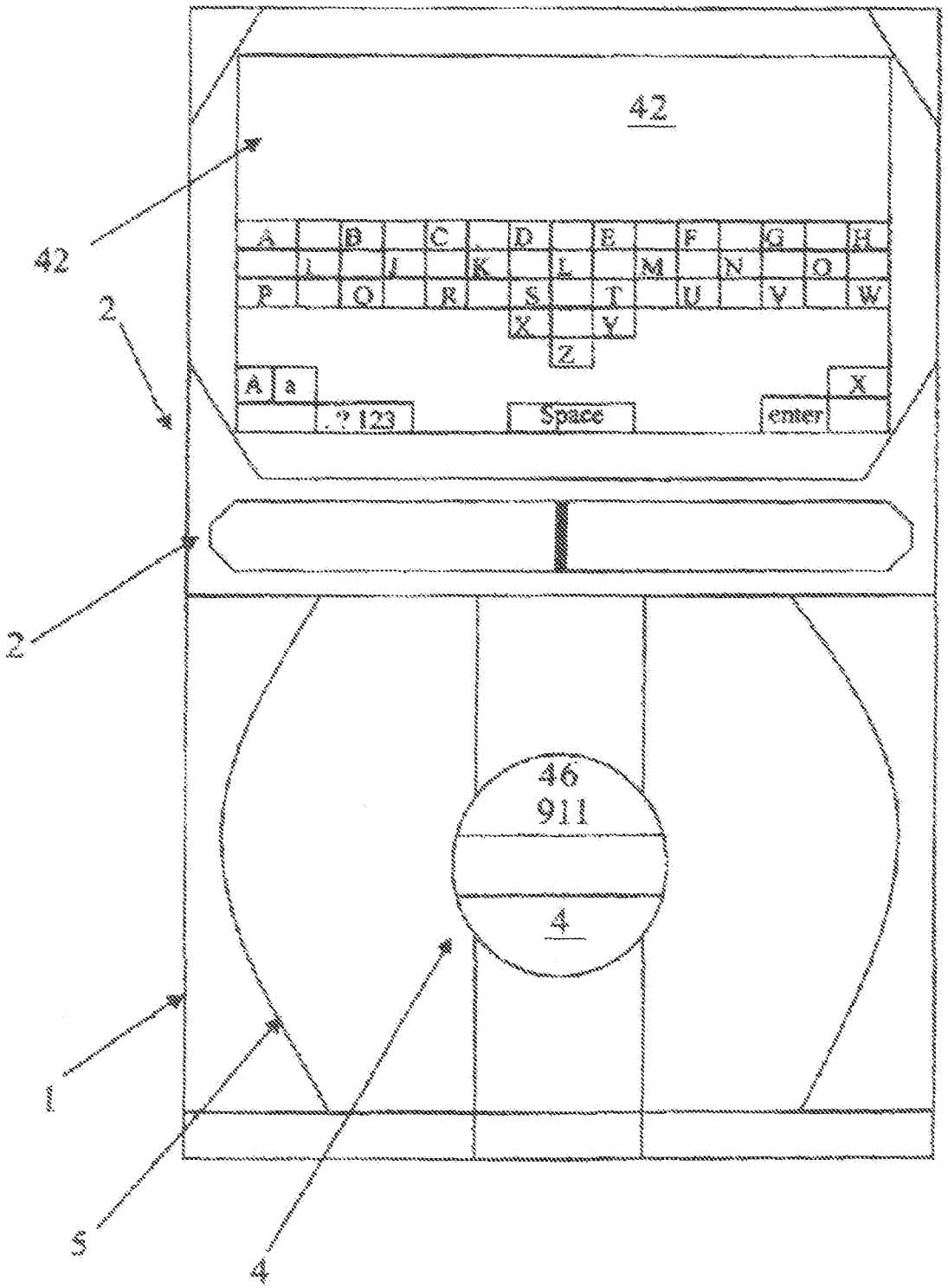
FIG. 1 is a perspective view of the front of the Debo Alarm System's Second Phase Keypad in Letter mode with detachable Mobile Module.

FIG. 1 is a perspective view of the front of the Debo Alarm System's Second Phase alarm system, with the keypad (2) in Letter mode with a detachable Mobile Module. The mobile module is attached to the keypad. The keypad (2) and mobile module (1) are both attached to the base station (3). The digital display (42) can be seen on the keypad (2). The keypad (2) and the carbon monoxide detector (4) which is part of the mobile module are both visible, and the digital keys on the keypad can be seen. In addition, the carbon monoxide detector (4) and one of the 911 function indicators (46) are on the mobile module. The speakers (5) are on both sides of the carbon monoxide indicator. In this version of the invention, the keypad is 7 inches (16.78 cm) tall. In this version of the invention, the mobile module (1) is 3 inches (7.62 cm) tall and 4.5 inches (11.34 cm) wide.

Figure 2:
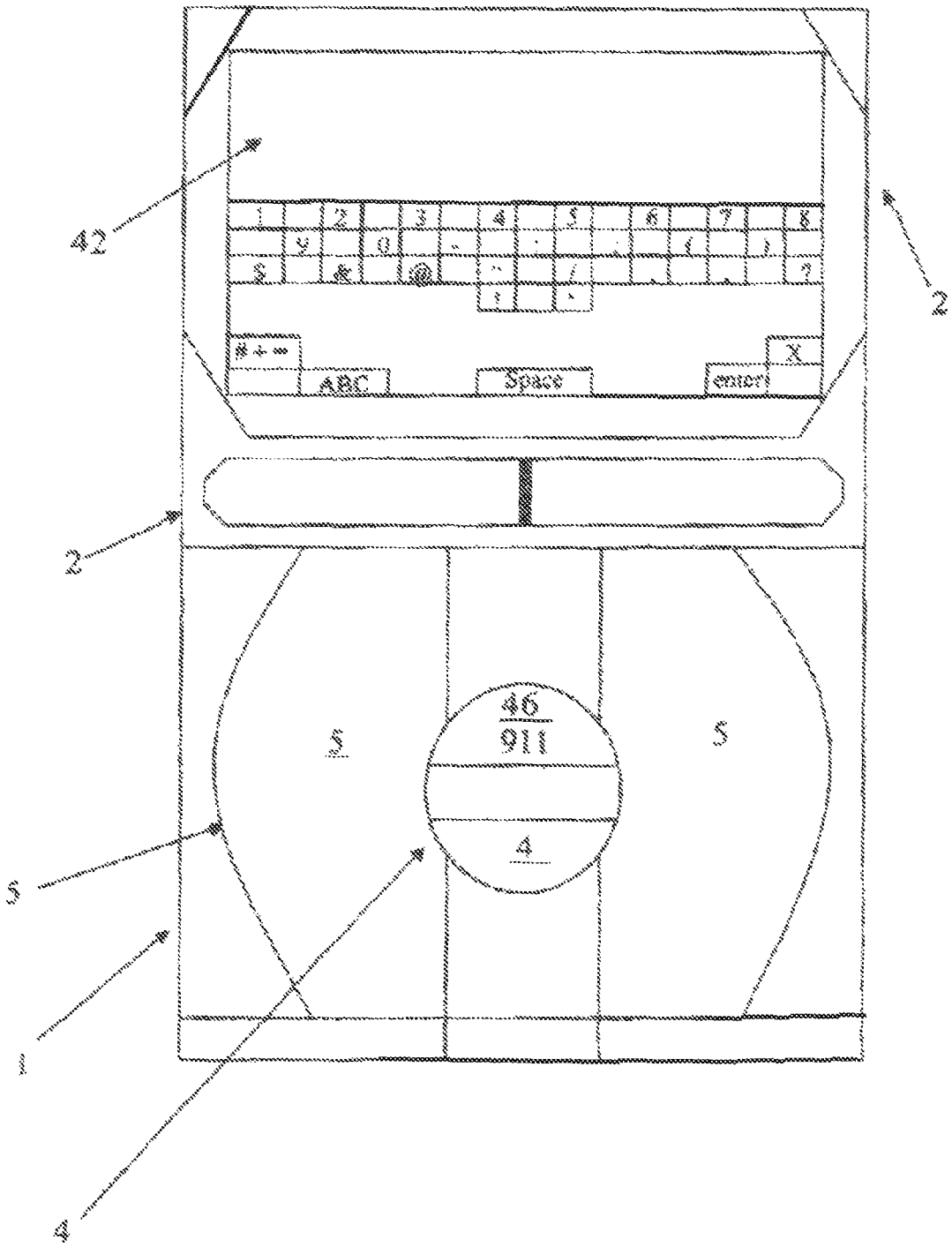
FIG. 2 is a perspective view of the front of the Debo Alarm System's Second Phase Keypad in Number/Symbol mode with detachable Mobile Module.

FIG. 2 is a perspective view of the front of the Debo Alarm System's Second Phase Keypad in Number/Symbol mode with a detachable Mobile Module. The mobile module is attached to the keypad. The keypad (2) and mobile module (1) are both attached to the base station (3). The digital display (42) can be seen on the keypad (2), and the visible digital keys are numbers and symbols. The keypad (2) and the carbon monoxide detector (4) are both visible, and the digital keys on the keypad can be seen. In addition, the carbon monoxide detector (4) and the 911 function indicator (46) are on the mobile module. The speakers (5) are on both sides of the carbon monoxide indicator. In this version of the invention, the mobile module (1) is 3 inches (7.62 cm) tall and 4.5 inches (11.34 cm) wide.

Figure 3:
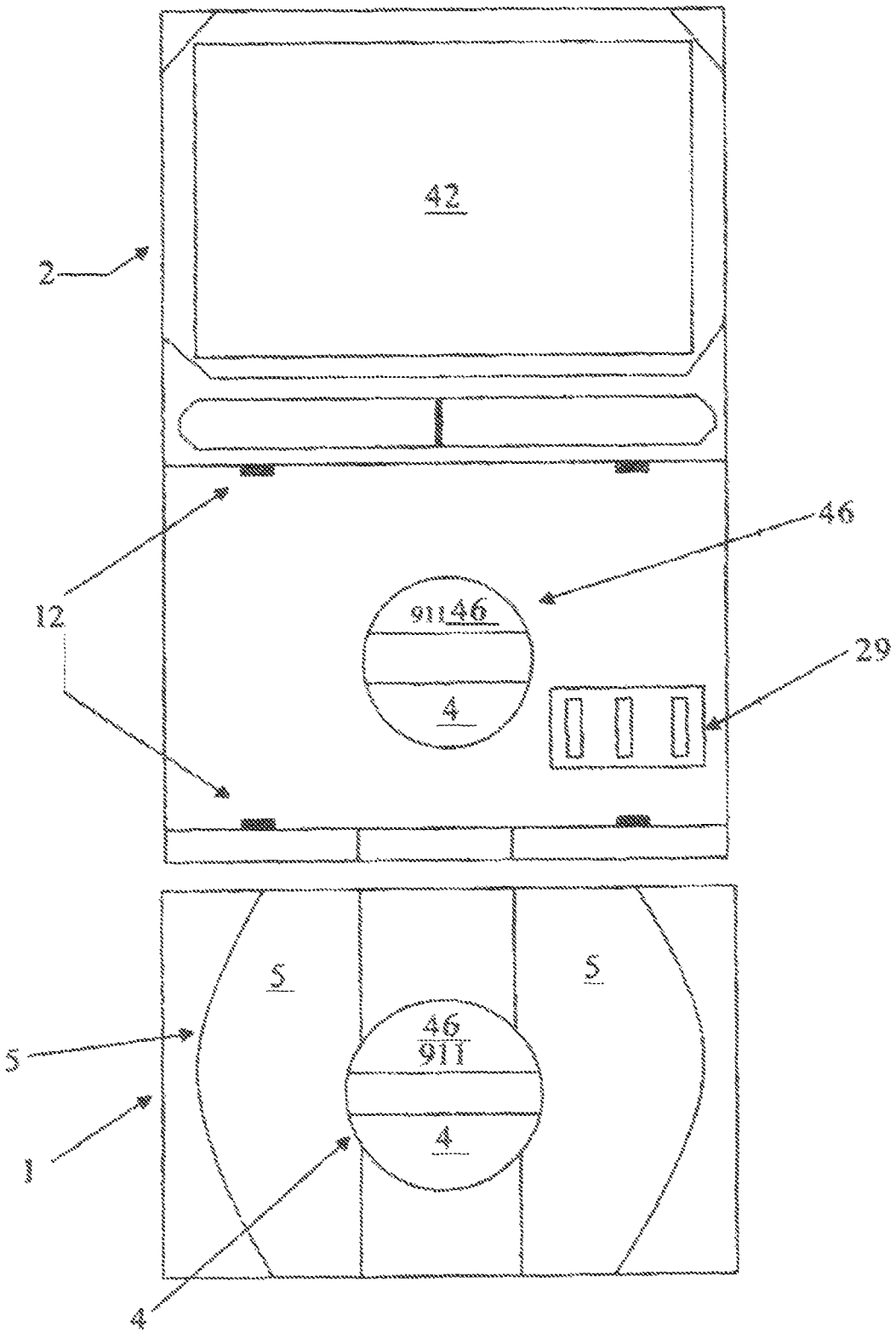
FIG. 3 is a perspective view of the front of the Debo Alarm System's Second Phase Keypad with the Mobile Module detached.

FIG. 3 is a perspective view of the front of the Debo Alarm System's Second Phase keypad (2) with the Mobile Module (1) detached. The viewer can see the carbon monoxide detector (4) and the 911 function button (46) that are part of the keypad, and the snaps (12) that allow the mobile module to be slid into the base station. The viewer can also see the power, data, and input connection (29), which allows power to be inputted into the mobile module when it is attached to the keypad. The mobile module (1) is separate from the keypad and below it, and the carbon monoxide detector, 911 function button, and speakers (5) that are part of the mobile module are clearly visible. The user can detach the mobile module from the keypad and carry it with him. In this embodiment of the invention, the keypad (2) is 7 inches (17.78 cm) tall, and 4.5 inches 11.33 cm) wide. The mobile module is 3 inches (7.62 cm) tall in this embodiment. The snaps (12) can be seen on the keypad (1).

Figure 4:
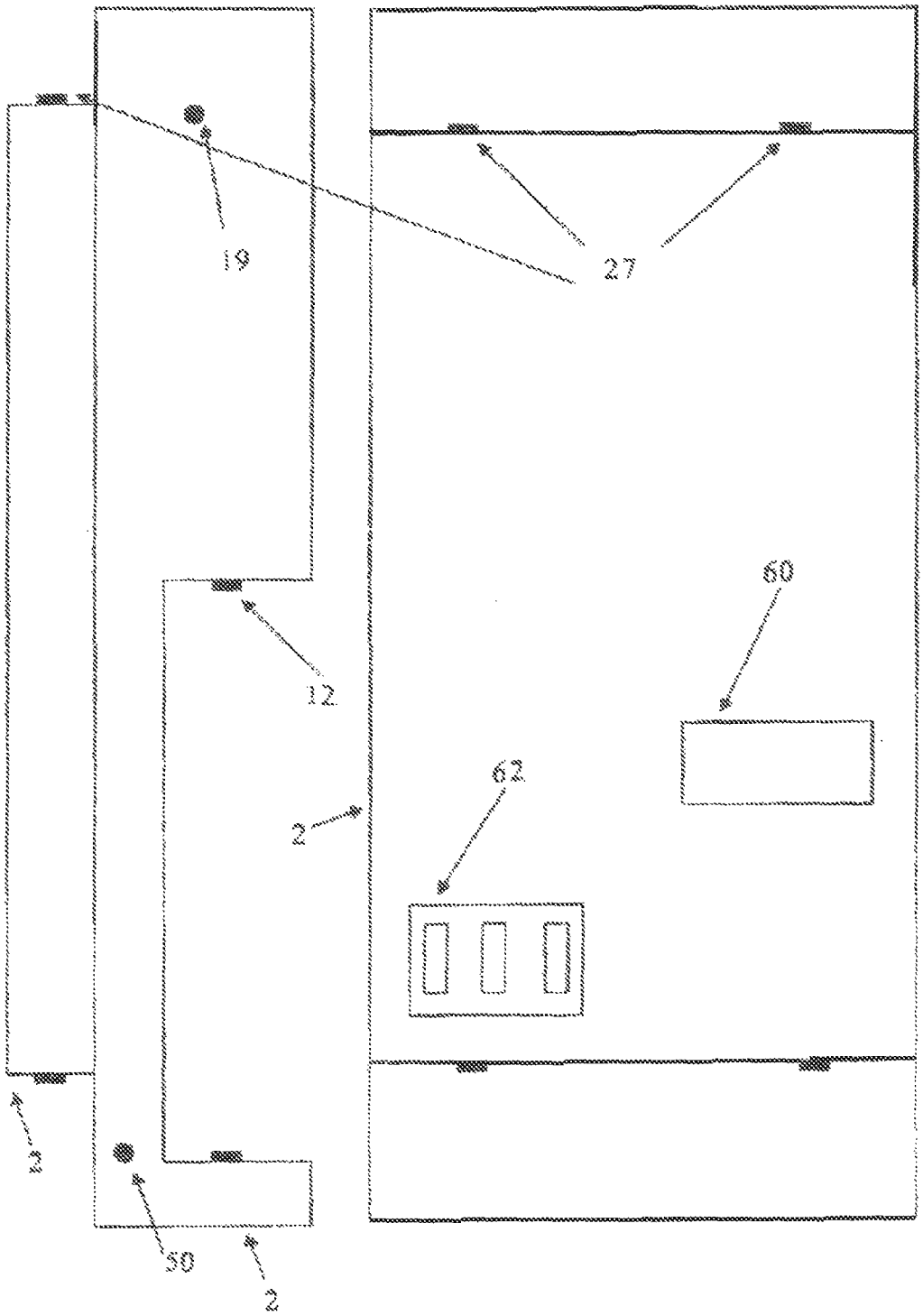
FIG. 4 is a perspective view of the back and side of the Debo Alarm System's Second Phase Keypad.

FIG. 4 is a perspective view of the back and side of the Debo Alarm System Second Phase's Keypad. The keypad input adapter (50) and keypad battery (60) are indicated, along with the keypad slots (27) that can be used to slide the keypad into the base station. Furthermore, the monitor set button (19) is visible and can be seen on the keypad. A keypad battery (60) and a keypad information port (62) through which data can be received from the base station (1) are also visible on the back of the keypad. There is also a keypad power adapter (61) through which a user can plug in a charging cord and recharge the keypad battery (60). The snaps through which the mobile module fits are also visible on the back of the keypad. The Keypad input adapter (50) can be used to recharge the internal battery. Snaps (12) can be seen on both the top and bottom of the cavity where the mobile module fits. These help hold the mobile module in place. In this embodiment of the invention, the entire keypad is 7 inches (17.78 cm) tall, and the back part of the keypad, which is supposed to connect to the mobile module, is 5.5 inches (13.97 cm) tall. The keypad is also 4.5 inches (11.43 cm) wide. There is a space on the bottom of the keypad where the mobile module will fit. The space is 3 inches (7.62 cm) tall, and the mobile module is also 3 inches (7.62 cm) tall, as will be seen. Therefore the mobile module fits tightly into the space on the bottom of the keypad. This space is also 1 inch (2.54 cm) in breadth. The front part of the keypad is 1.5 inches (3.81 cm) in breadth, and the back part of the keypad, which fits into the mobile module, is ¾ of an inch (1.91 cm) in breadth.

Figure 5:
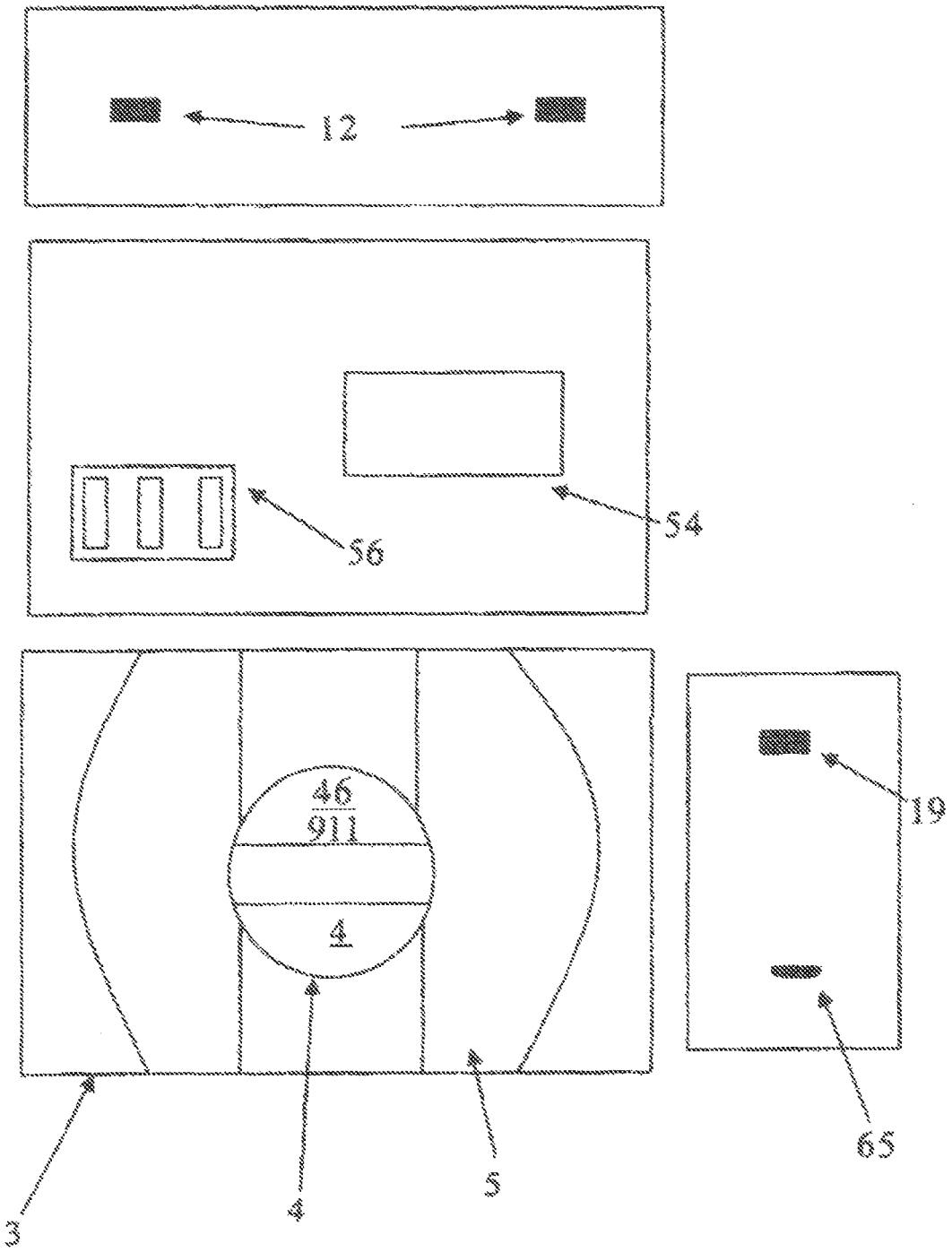
FIG. 5 is a perspective view of the front, back, side and top of the Mobile Module.

FIG. 5 is a perspective view of the front, back, side and top of one embodiment of the Mobile Module. The top of the mobile module includes the snaps (12) on which the mobile module can be attached to the keypad (2). The back of the mobile module includes a charger inlet (56), through which the mobile module can receive data and power from the keypad (2) or another source. The location of an internal, rechargeable mobile module battery (54) is also indicated. The front, below, shows the 911 function button, the carbon monoxide detector (4), and two speakers (5). In addition, a monitor set button (19) can be seen on the side of the mobile module. A mobile module AC/DC inlet (65) is also visible on the side of the mobile module. The mobile module can receive electricity to operate through the mobile module charging inlet.

Figure 6:
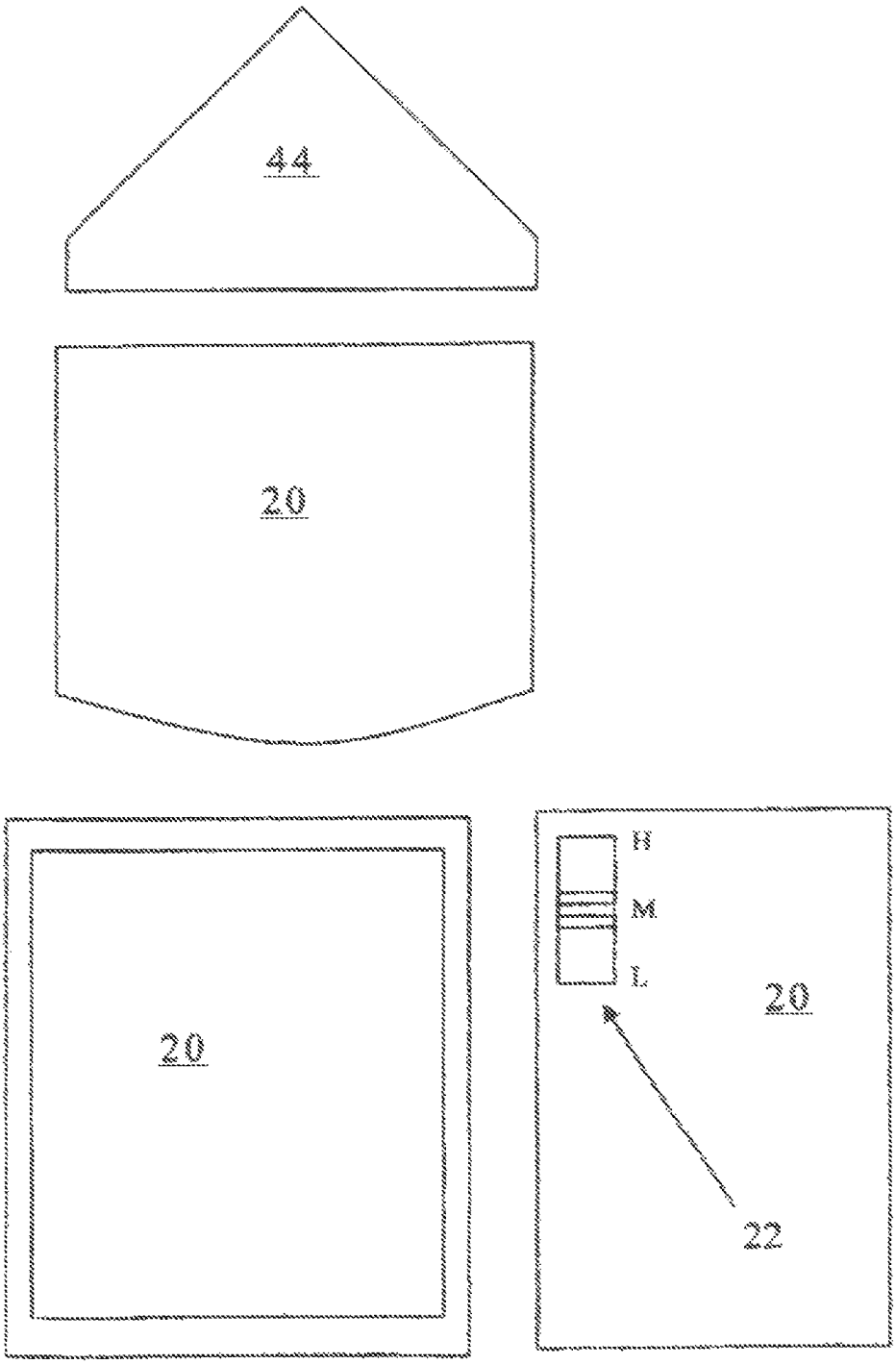
FIG. 6 is a perspective view of the front, top and side of the Debo Alarm System's Second Phase Motion Detector with the top view of the motion detector's adaptor. The detector's adaptor is stuck on the back of the motion detector to fit in the corner of a room.

FIG. 6 is a perspective view of the front, top and side of the Debo Alarm System's Second Phase Motion Detector with the top view of the motion detector adapter (44). The motion detector adapter (44) is stuck on the back of the motion detector to fit in the corner of a room. That is the reason for the shape of the motion detector adapter. In this embodiment, it is 2 inches (5.08 cm) in width. There is also a top view of the motion detector (20). In this embodiment, the motion detector is 1 and 13/16 inches (4.60375 cm) long. There is a front view of the motion detector, which, in this embodiment, is 3 inches (7.62 cm) in height and 2 inches (5.08 cm) in width. In one diagram, the sensitivity switch (22) is visible.

Figure 7:
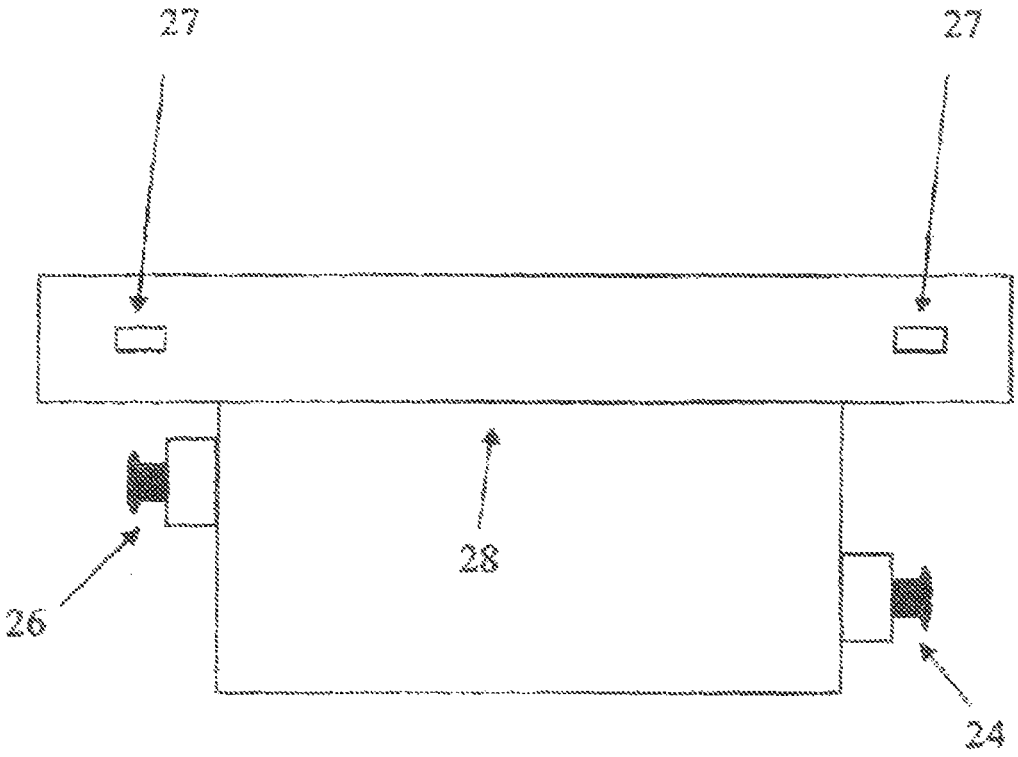
FIG. 7 is a perspective view of the top of the Debo Alarm System's Second Phase Base that houses the keypad. The Base is installed where the central light switch is located.

FIG. 7 is a perspective view, from the top, of the Debo Alarm System's Second Phase base station (3) that houses the keypad (2). The base station (3) is most preferably installed where the central light switch is located inside the dwelling. (26) is the negative connection to connect the negatively charged wire in the light switch area. (24), is the positive connection to connect the positively charged wire from inside the wall in the light switch area. The location of one of the screw holes (28) is indicated. (27), is a keypad slot to snap the keypad into the base. The various distances discussed listed show the dimensions of the preferred embodiment of the Debo alarm system. The back part of the base station, which contains the positive (24) and negative (26) connections, is about 3.5 inches (8.89 cm) tall in this embodiment. It is 1.5 inches (3.81 cm) wide, 2.5 inches (6.35 cm) in breadth, and may extend that far into the wall when placed in the location normally held by a light switch. The front part of the base station (1) is 13/16 of an inch (2.06375 cm) wide. The front part of the base station extends above the top of the back part by about 1 and 1/16 inches (2.69875 cm).

Figure 8:
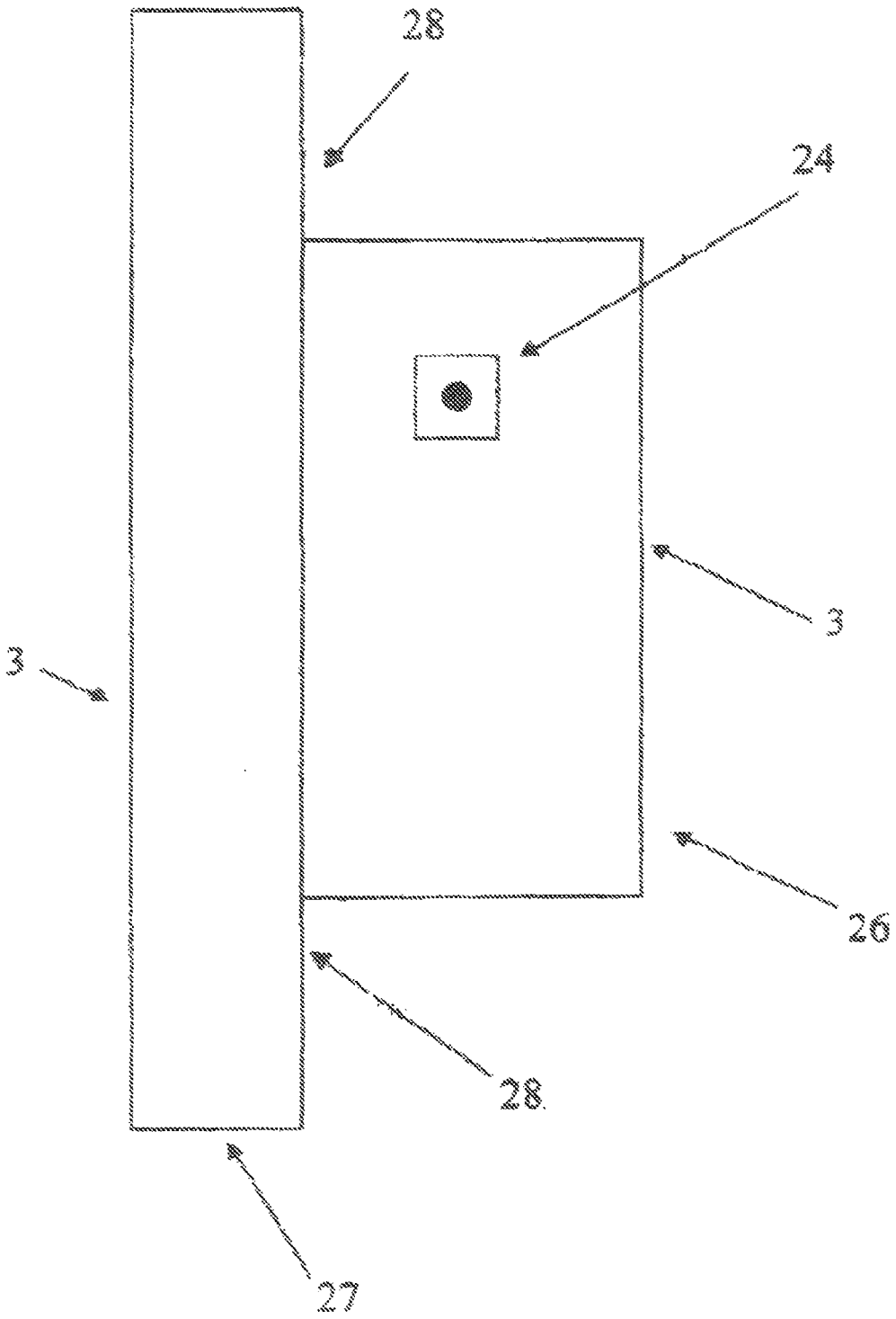
FIG. 8 is a perspective view of the left side of the Debo Alarm System's Second Phase Base that houses the keypad. The Base is installed where the central light switch is located.

FIG. 8 is a perspective view, from the left, of the Debo Alarm System's Second Phase base station (3) that houses the keypad (2). The base station (3) is most preferably installed where the central light switch is located inside the dwelling. (26) (not visible) is the negative connection to connect the negatively charged wire in the light switch area. (24), is the positive connection to connect the positively charged wire from inside the wall in the light switch area. The various distances listed show the dimensions of the preferred embodiment of the Debo alarm system. The Debo alarm system can be installed by removing the light switch panel from the wall where it is attached, connecting the positively charged wire from inside the wall to the positive connection (24), connecting the negatively charged wire from inside the wall to the negative connection (26), and screwing the base station (3) into the wall via the screw holes (28). This process is explained in further detail above. The back part of the base station, which contains the positive (24) and negative (26) connections, is about 3.5 inches (8.89 cm) tall in this embodiment. It is 1.5 inches (3.81 cm) wide, and may extend that far into the wall when placed in the location normally held by a light switch. The front part of the base station (1) is 13/16 of an inch (2.06375 cm) wide. The front part of the base station extends above the top of the back part by about 1 and 1/16 inches (2.69875 cm). (11) indicates the location of an internal, rechargeable battery.

Figure 9:
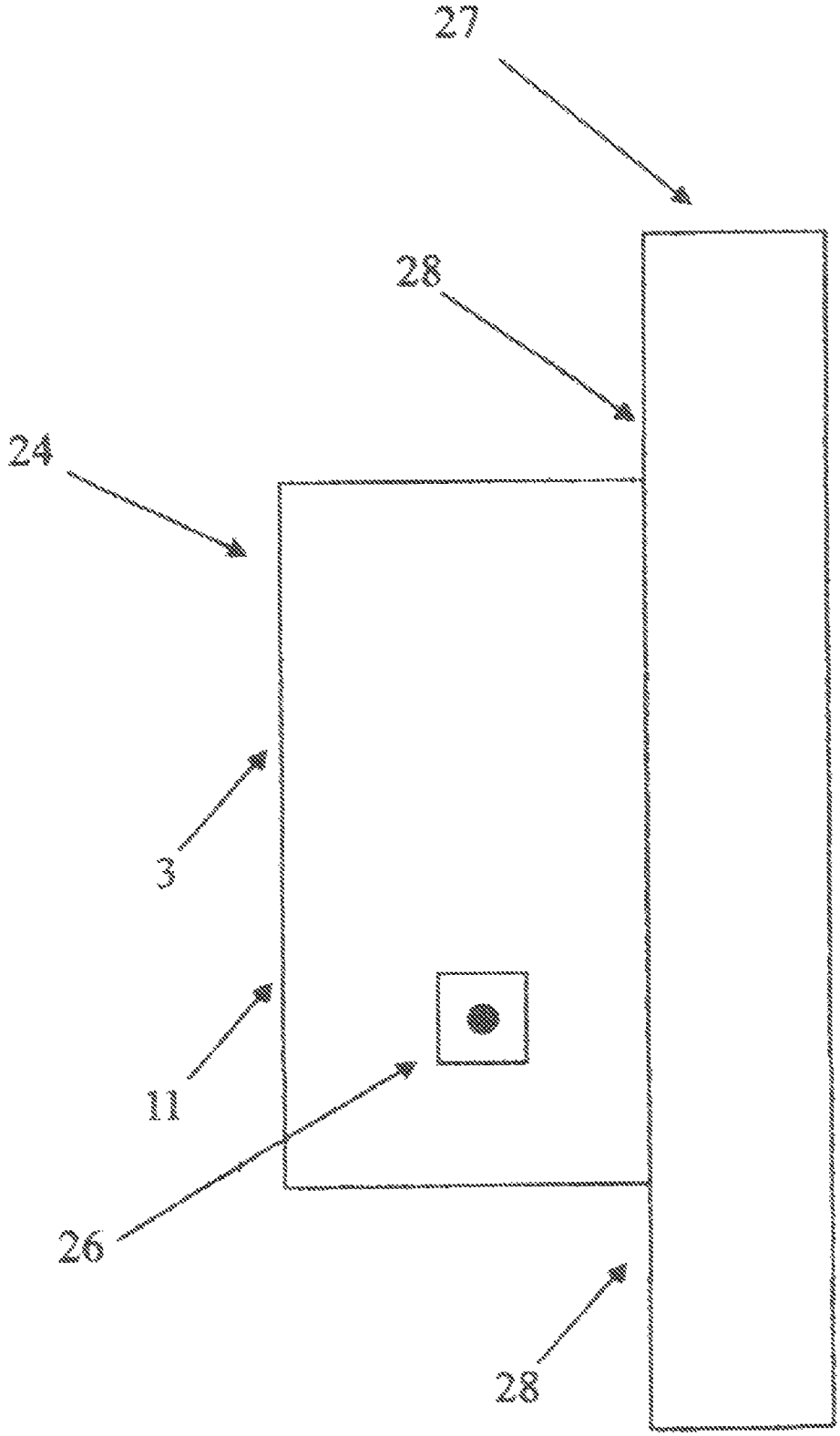
FIG. 9 is a perspective view of the top of the Debo Alarm System's Second Phase Base that houses the keypad. The Base is installed where the central light switch is located.

FIG. 9 is a perspective view, from the right, of the Debo Alarm System's Second Phase base station (3) that houses the keypad (2). The base station (3) is most preferably installed where the central light switch is located inside the dwelling. (24) (not visible) is the positive connection to connect the positively charged wire in the light switch area. (11) (not shown) is an internal rechargeable battery in case the power in the area you are the user is trying to secure goes out. An approximate location for (11) is shown, but it can be located in other places. (26), is the negative connection to connect the negatively charged wire from inside the wall in the light switch area. The back part of this embodiment of the base station, which contains the positive (24) and negative (26) connections, is about 3.5 inches (8.89 cm) tall in this embodiment. It is 1.5 inches (3.81 cm) wide, and may extend that far into the wall when placed in the location normally held by a light switch. The front part of this embodiment of the base station (1) is 13/16 of an inch (2.06375 cm) wide. The front part of this embodiment of the base station extends above the top of the back part by about 1 and 1/16 inches (2.69875 cm). The various distances listed show the dimensions of the preferred embodiment of the Debo alarm system.

Figure 10:
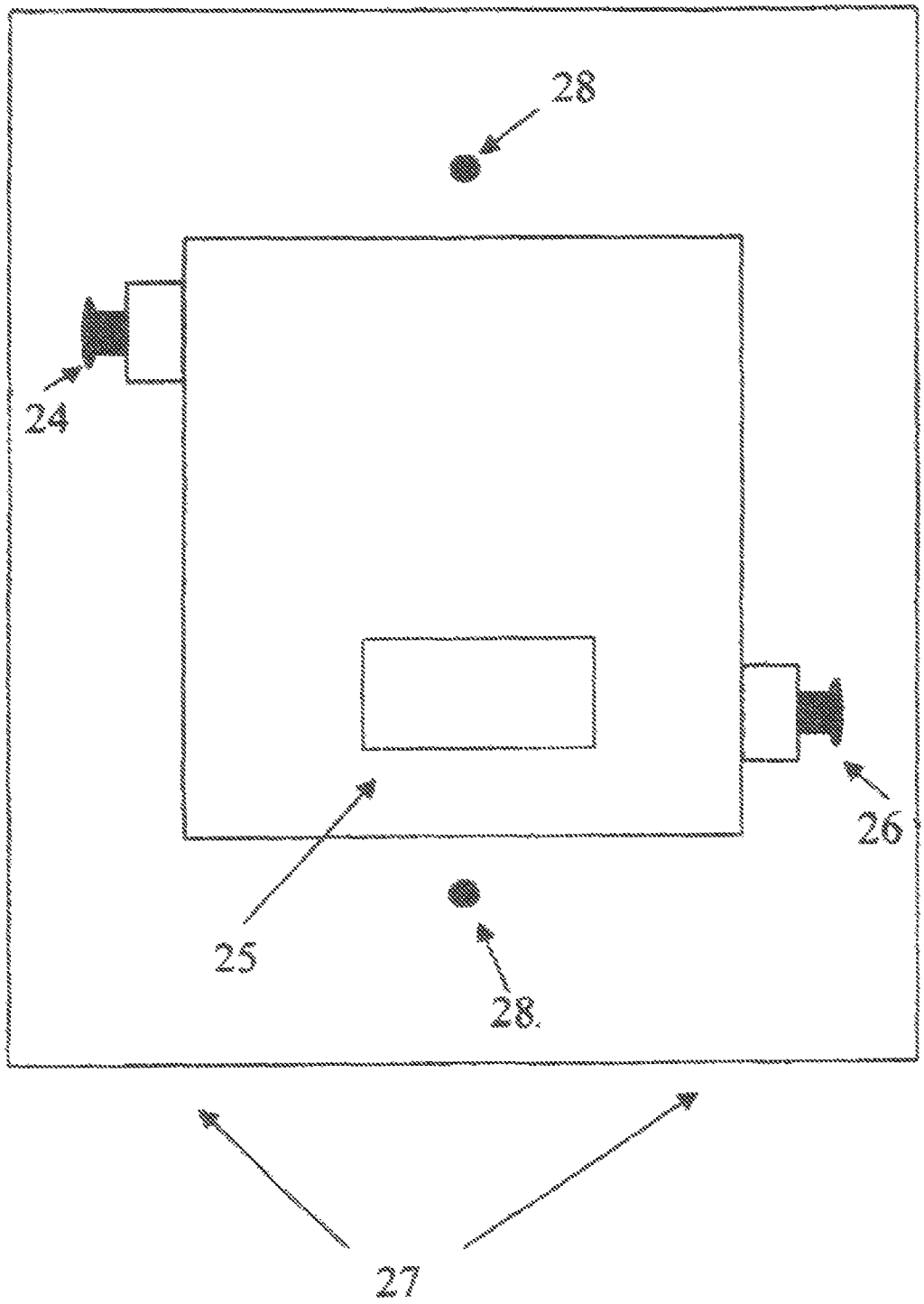
FIG. 10 is a perspective view of the back of the Debo Alarm System's Second Phase Base Station that houses the keypad. The Base Station is installed in a residence where one of the central light switches is located.

FIG. 10 is a perspective view of the back of the Debo Alarm System Second Phase's base station that houses the keypad. The base station is installed in a residence, in the location where the central light switch is located. The positive connection (24) and negative connection (26) are both visible, and the user can place positive and negatively charged wires, respectively, on the positive connection (24) and negative connection (26) to power the base station. Screw holes (28) where the user can place screws to attach the base station (3) to the wall are also visible. There is also an internal, rechargeable battery, that is part of the base station. A slot which can be used to slide a keypad into a connection with the base station is also indicated. This version of the Base Station is about 5 and 9/16 inches (14.12875 cm) tall and 4 and 9/16 inches (11.58875 cm) across. It contains an internal, rechargeable battery that is 13/16 inches (2.06375 cm) tall and 1.5 inches (3.81 cm) across. The part of the base station where the positive and negative connections are housed is 2.5 inches (6.35 cm) across. This makes it easier for this part of the base station to fit inside the wall in place of a light switch.

Figure 11:
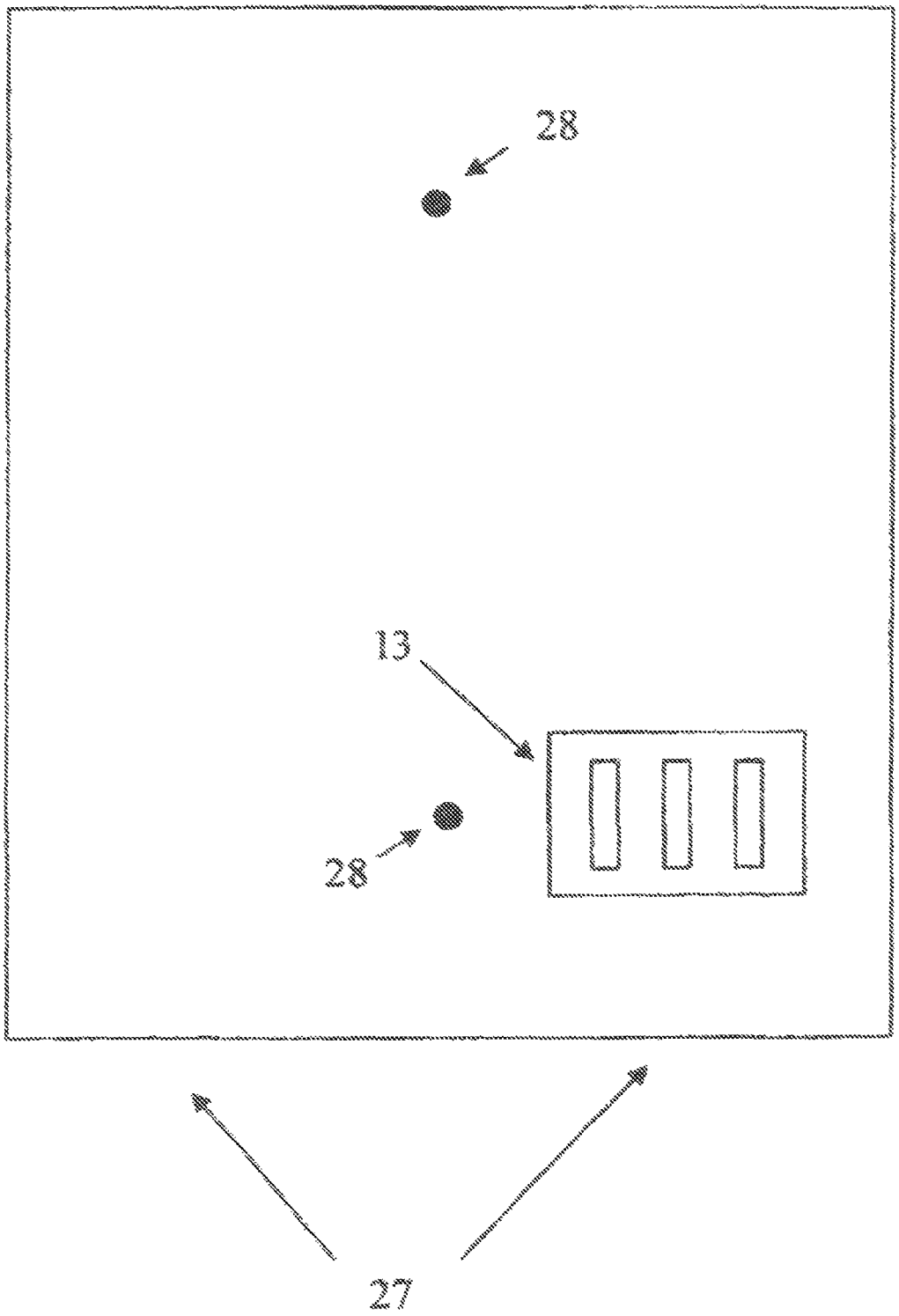
FIG. 11 is a perspective view of the front of the Debo Alarm System Second Phase's base that houses the keypad. The base is installed in a residence, in the location where the central light switch is located.

FIG. 11 is a perspective view of the front of the Debo Alarm System Second Phase's base station that houses the keypad. The base station is installed in a residence, in the location where the central light switch is located. The two screw holes (28) are shown, and the user places screws in these holes to attach the base to the wall of a residence. The data transfer port (13) is also visible. It is about 1 and ½ inches (3.81 cm) across and 1 inch (2.54 cm) tall in this embodiment of the invention. This version of the Base Station is about 5 and 9/16 inches (14.12875 cm) tall and 4 and 9/16 inches (11.58875 cm) across.

Figure 12:
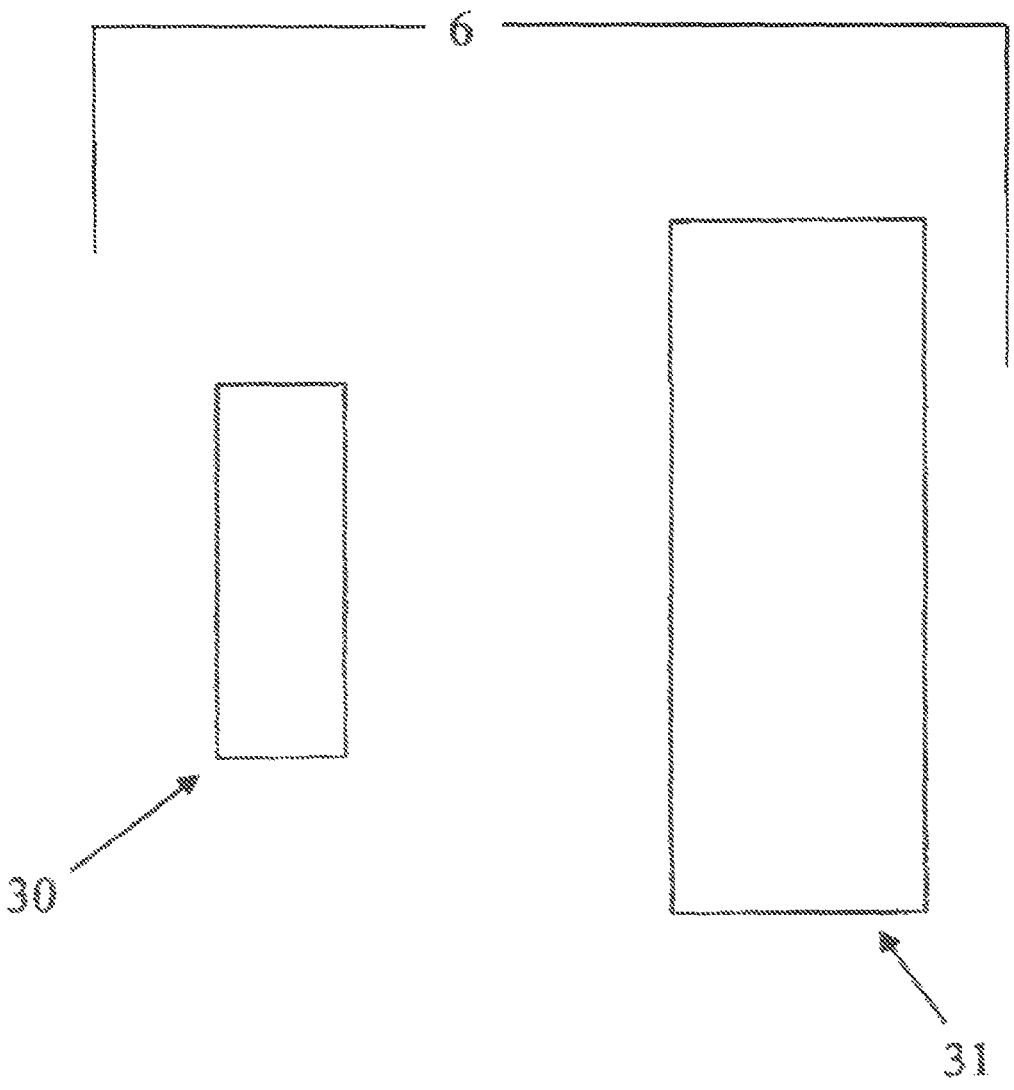
FIG. 12 is a perspective view of the Debo Alarm System's Second Phase Magnet and Receiver, which are movable or stationary devices.

FIG. 12 is a perspective view of the Debo Alarm System's Second Phase Magnet and Receiver, which are movable or stationary devices. The magnet and receiver comprise a monitor (6), and the user can observe how the magnet and receiver fit against each other. The magnet is about 2 inches (5.08 cm) tall and ½ inch (1.27 cm) wide, and the receiver is about 2 and ½ inches (6.35 cm) tall and 1 inch (2.54 cm) wide, in this embodiment. Magnets and receivers of other sizes are possible.

Figure 13:
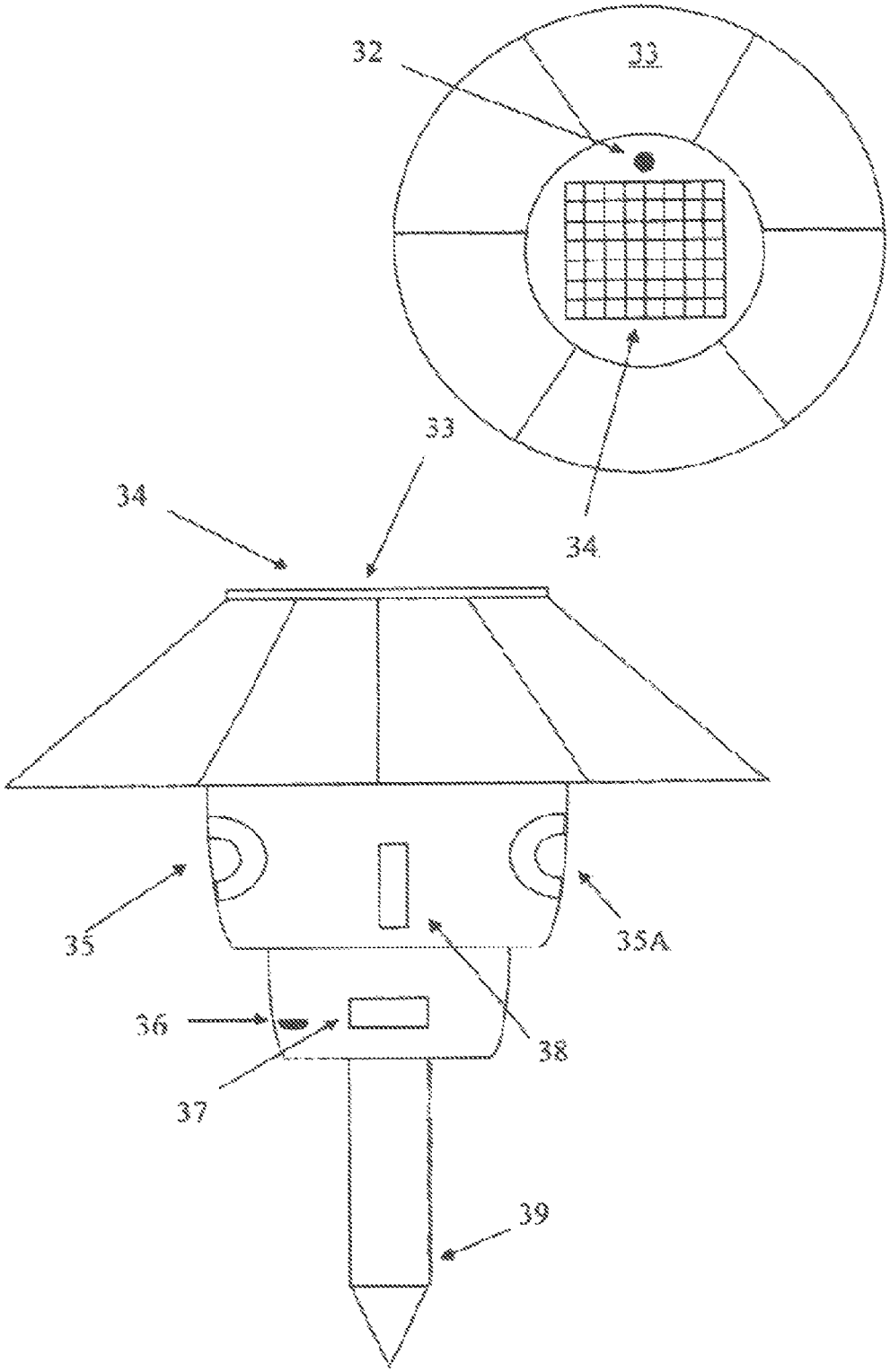
FIG. 13 is a perspective view of the top, front and side of the Debo Alarm System's Second Phase Perimeter Sensor. The Perimeter Sensor for the Debo Alarm System's Second Phase can be used to create a perimeter around the user's House, Worksite, Campsite, or another location which the user desires to protect.

FIG. 13 is a perspective view of the top, front and side of the Debo Alarm System's Second Phase Perimeter Sensor. The Perimeter Sensor for the Debo Alarm System's Second Phase can be used to create a perimeter around the user's House, Worksite, Campsite, or another location which the user desires to protect. The viewer can see the top of the perimeter sensor including the set perimeter button and solar panel. The solar panel (34) keeps the sensor working using its own power source, and charges the perimeter battery (37). After the perimeter battery is fully charged the Perimeter Sensor will work though out the night. The laser reader (40) and laser (36) for one of the perimeter sensors are also visible. The viewer can also see, protruding from the perimeter sensor (33), a stake (39) which can be used to place the perimeter sensor in the ground. A user should stake the Perimeter Sensors into the ground in the locations where the user wants to establish the edges of his perimeter. A perimeter sensor adapter (41) can be seen on the side of the perimeter sensor. This charges the mobile module (1) or a cellular phone when the user is camping. The Perimeter Sensor has enough power to charge a laptop computer during the time that the sun is down. The Perimeter Sensor in this embodiment is about 9 inches (22.86 cm) tall from the point of the stake to the solar panel.

The invention claimed is:

1. A mobile security system which can be used to secure an area such as a home, apartment, recreational vehicle, commercial business, vacation suite, or another location, said security system comprising: a base station (3), a mobile module (1), and a keypad (2), and one or more sensors;

where said sensors are in wireless communication with said keypad (2), and capable of wirelessly informing said keypad (2) of activity within the secured area;

where said base station (3) includes two screw holes (28), a data transfer port (13), a rechargeable battery (11), and an AC/DC charging outlet (14), and also a positive connection (24) and a negative connection (26), which, are capable of receiving positive and negatively charged electricity, respectively, to power said base station, and any mobile module and keypad attached to said base station;

where said positive connection (24) and negative connection (26) are on the outside of said base station; where said AC/DC charging outlet (14) carries power to said rechargeable battery (11), thus replenishing the charge of said rechargeable battery (11) if said rechargeable battery (11) is reduced below 100% of said rechargeable battery's capacity;

where said AC/DC charging outlet (14) carries electrical power which can be used by said base station (3) and, said AC/DC charging outlet (14) carries electrical power to said mobile module (1) when said mobile module (1) is attached to said base station; and said AC/DC charging outlet (14) carries electrical power to said keypad (2); if said keypad is attached to said base station;

where said rechargeable battery (11) provides electrical power to said base station (3) and, provides electrical power to said mobile module if said mobile module (1) is attached to said base station (3), and provides electrical power to said keypad if said keypad (2) is attached to said base station;

where said keypad (2) includes a digital display (42), with a touchscreen, on which can be displayed a digital keyboard, where the user can press the keys in said digital keyboard to enter information into said keypad, and said information entered into said keypad can be saved by said keypad, where said mobile module (1) and keypad (2) are capable of being attached to said base station (3) and also detached from said base station (3) without the use of any tools;

where said mobile module (1) and keypad (2) are in wireless communication with each other when said mobile module (1) and keypad (2) are not attached to each other, so that said keypad (2) can wirelessly inform said mobile module (1) of a security breach whenever said sensors inform said keypad (2) of activity within the secured area;

where said mobile module includes a 911 function button which has the capacity to contact an emergency services number when said mobile module receives notice of activity within the secured area from said keypad;

where said security system also includes speakers (5) which are attached to one or more of said base station (3), said keypad (2), and said mobile module (1), where said speakers have the ability to make a loud noise when said keypad (2) receives notice of activity within the secured area from said sensors;

where no rewiring of the electrical system of the secured area is necessary for said security system to function, and said base station (3) can be installed into the secured area through said base station (3) being placed in the space occupied by a standard light switch panel with two light switches via the following steps;

first, the ground screws holding said light switch panel in place are unscrewed, and said light switch panel is removed from the wall where said light switch panel has been placed;

second, a positively charged wire from inside said wall is placed on said positive connection (24), and a negatively charged wire from inside said wall is placed on said negative connection (26);

third, said base station (3) is inserted back partly into the wall so that the side of said base station containing said positively charged connection (24) and said negatively charged connection (26) is either inside of, or facing, said wall;

and then screws are inserted through said screw holes (28) and through the holes left by the ground screws in said wall, and then said screws are tightened sufficiently to hold said base station (3) in place; and then electricity to power said base station, and any keypad or module that is attached to said base station, will be drawn from said positive wire and said negative wire via said positively charged connection (24) and said negatively charged connection (26) respectively.

2. The portable alarm system of claim 1 where said mobile module also includes a carbon monoxide detector (5), which is capable of detecting carbon monoxide.

3. The alarm system of claim 1, further comprising that the information that the user can enter into said digital keypad includes three categories of information comprising: first the specific location of the user within a building, second, a safety code, and third, the number of people living in the user's dwelling, and said three categories of information will be recognized as the specific location of the user within a building, second, a safety code, and third, the number of people living in the user's dwelling, respectively, and stored as the specific location of the user within a building, second, a safety code, and third, the number of people living in the user's dwelling, respectively, by said alarm system, and if said mobile module (1) calls an emergency services number, said mobile module will transmit information including said three categories of information to the answering 911 operator so that these three categories of information appear on said 911 operator's screen.

4. The portable alarm system of claim 1 further comprising that the mobile module (1) comprises: a mobile module battery (54) which can power said mobile module, and a charger inlet, where a power cord can be run from said charger inlet to a wall socket, and said power cord can be plugged into said charger inlet and wall socket, so that said mobile module (1) and said mobile module battery (54) can be charged via said wall socket.

5. The mobile security system of claim 1, further comprising that some or all of the sensors are monitors (6), which are mounted on the designated windows and doors, or other locations, that the user is trying to secure, where each said monitor comprises: a magnet and a receiver, where said receiver is capable of detecting whether said magnet is touching said receiver;

where, the magnet and receiver comprising each of said monitors are touching each other when each of said monitors is initially mounted on one of the locations to be secured, and where said receivers are in wireless communication with said base station and/or said mobile module, where, if the magnet and the receiver comprising any of the monitors are separated from each other, said receiver will communicate the fact that said monitor and receiver are separated from each other to one or more of said base station, and/or said keypad, and/or said mobile module, and one or more of said base station, and/or said keypad, and/or said mobile module which have received the information that said monitor and receiver are separated from each other will then cause said speakers to sound an alarm.

6. The mobile security system of claim 1, further comprising that some or all of the sensors are motion detectors, where each said motion detector detects movement in a specific area.

7. The mobile security system of claim 6, further comprising that each of said motion detectors includes an adapter in the back of said motion detector, so that said motion detector can receive new electrical power when said motion detector is in use.

8. The portable alarm system of claim 1, further comprising that the mobile module (1) has the ability to be attached to the base station (3) via being attached to the keypad (2); and said keypad (2) contains an outlet by which electrical power can be transferred from said keypad to said mobile module, to power said mobile module and charge any batteries therein.

9. The portable alarm system of claim 8, further comprising that each perimeter sensor includes a solar cell (34) capable of providing electrical power to said perimeter sensor.

10. The portable alarm system of claim 9, further comprising that each perimeter sensor includes a perimeter sensor adapter (41), which is operatively connected to the solar cell and perimeter battery so that the solar cell and perimeter battery can provide electrical power to a cellular phone, mobile module, or laptop which is plugged into the perimeter sensor adapter (41) via a charging cord.

11. The portable alarm system of claim 9, further comprising a stake (39) attached to each of said perimeter sensors, where each said stake can anchor one of said perimeter sensors in the ground, if said stake is pressed into the ground.

12. The portable alarm system of claim 9, further comprising that said mobile module has the capability to be physically connected to said keypad and/or said base station, and said mobile module has the capability to receive data from and/or send data to said keypad via a physical connection to said keypad.

13. The portable alarm system of claim 1, further comprising that said mobile module is capable of wirelessly communicating with sensors in the vicinity of said mobile module, so that if said sensors are monitoring activity within a secured area, said sensors can inform said mobile module of activity which said sensors detect within said secured area.

14. The portable alarm system of claim 13, further comprising that each perimeter sensor includes an internal, rechargeable perimeter battery (37) which can provide electrical power to said perimeter sensor, and where said internal, rechargeable perimeter battery (37) is operatively connected to said solar cell (34) so that said solar cell can recharge said perimeter battery.

15. The portable alarm system of claim 1, further comprising that some or all of the sensors are "perimeter sensors", each of which comprises a "perimeter button" (32) that activates the perimeter sensor, at least one laser (40), and at least one laser reader (36) where said laser reader (36) is capable of reading the presence or absence of a beam from a laser (40);

and where each of the perimeter sensors notifies the base station (3) and/or mobile module (1) of the presence or absence of a beam from a laser (40);

where, when one of the beams from a laser (40) is broken, the mobile module and/or the base station will cause the speakers (5) to make a loud noise;

where the user may, if the user chooses, create a "perimeter" of beams from the lasers by setting one or more perimeters sensor in a position where the laser(s) of each perimeter sensor touches the laser reader of another perimeter sensor.

16. The portable alarm system of claim 15, further comprising that each perimeter sensor includes a light and motion detector, where each of the perimeter sensors notifies the base station and/or mobile module if the light and motion detector detects light or motion, so that, when one of the light and motion detectors detects light or motion, the base station and/or the mobile module will cause the speakers to make a loud noise.

17. An apparatus for securing a dwelling or other area comprising: a base station (3), further comprising: at least two screw holes (28), and a positive connection (24) and a negative connection (26) and an AC/DC charging outlet, and said apparatus further comprising: a keypad which can be attached to said base station and can draw electrical power from said base station when attached said base station;

where said base station can be installed in one of the standard light switch panels in a secured area through the following manner;

first, the ground screws holding said light switch panel in place are unscrewed, and said light switch panel is removed from the wall where the light switch panel has been placed;

second, a positively charged wire from inside said wall is placed on said positive connection (24), and a negatively charged wire from inside said wall is placed on said negative connection (26);

third, said base station (3) is inserted back partly into the wall so that the side of said base station containing said positively charged connection (24) and said negatively charged connection (26) is either inside of, or facing, said wall;

and then screws are inserted through said screw holes (28) and through the holes left by the ground screws in said wall, and then said screws are tightened sufficiently to hold said base station (3) in place, so that said base station and any keypad attached to said base station can draw electrical power from said positive wire and said negative wire via said positively charged connection (24) and negatively charged connection (26) respectively;

and said apparatus further comprising one or more sensors in wireless communication with said keypad.

* * * * *